US006145414A

United States Patent [19]

Hsieh

[11] Patent Number: 6,145,414

[45] Date of Patent: Nov. 14, 2000

[54] OPEN END WRENCH FOR TURNING NORMAL AND WORN-OUT BOLTS AND NUTS OF DIFFERENT SPECIFICATIONS

[76] Inventor: Chih-Ching Hsieh, No. 64, Lane 107, Liang Tsun Rd., Fong Yuan City, Taichung Hsien, Taiwan

[21] Appl. No.: 09/012,649

[22] Filed: Jan. 23, 1998

[51] Int. Cl.[7] ..... B25B 13/02

[52] U.S. Cl. ..... 81/119; 81/186

[58] Field of Search ..... 81/119, 120, 186

[56] References Cited

U.S. PATENT DOCUMENTS

| | | | |
|---|---|---|---|
| 834,807 | 10/1906 | Hoffmann | 81/186 |
| 5,148,726 | 9/1992 | Huebschen et al. | 81/119 |
| 5,551,322 | 9/1996 | Mikic et al. | 81/119 |

FOREIGN PATENT DOCUMENTS

| | | | |
|---|---|---|---|
| 644905 | 10/1950 | United Kingdom | 81/186 |

*Primary Examiner*—David A. Scherbel
*Assistant Examiner*—Joni B. Danganan
*Attorney, Agent, or Firm*—Varndell & Varndell, PLLC

[57] ABSTRACT

An open end wrench having a mouth defined between two jaws and a nest. A longitudinal series of transversely extended flat teeth are provided at each of the two jaws within the mouth, so that the longitudinal series of transversely extended flat teeth includes a first tooth remote from the nest, a third tooth adjacent to the nest, and a second tooth spaced between the first tooth and the third tooth by a respective transverse groove. The first tooth has a front side remote from the second tooth and a rear side adjacent to the second tooth. The longitudinal lengths of the first tooth, the second tooth and the third tooth have a ratio of 4:3:3:. The longitudinal length of the longitudinal series of transversely extended flat teeth is equal to 0.39 of the width of the mouth, and 0.77 of the distance from the front side of the first tooth to the nest.

1 Claim, 14 Drawing Sheets

OPEN END WRENCH FOR TURNING NORMAL AND WORN-OUT BOLTS AND NUTS OF DIFFERENT SPECIFICATIONS

BACKGROUND AND SUMMARY OF THE INVENTION

The present invention relates to open end wrenches, and more particularly to an improved structure of open end wrench which is practical for grasping and turning normal bolts and nuts of different specifications as well as worn-out bolts and nuts of different specifications.

An open end wrench is handy tool intensively used for grasping and turning bolts and nuts. A variety of open end wrenches have been disclosed having teeth, raised portions or rough grasping faces at the jaws for grasping and turning normal bolts and nuts as well as worn-out bolts and nuts. Exemplars of conventional open end wrenches are shown in Figures from 1 to 13. The open end wrench shown in FIGS. 1, 2, and 3 has two flat raised portions at the jaws. This structure of open end wrench is functional for turning normal bolts and nuts as well as slightly worn-out bolts and nuts. However, it can not positively grasp and turn excessively worn-out bolts and nuts. FIGS. 4, 5, 7, 8, 9, 10 and 11 show other different designs. These designs can grasp and turn bolts and nuts of different sizes. However, these designs can not positively grasp and turn excessively worn-out bolts and nuts. FIG. 6 shows another design of open end wrench which is similar to the open end wrench shown in FIGS. 1 to 3. FIG. 12 shows an open end wrench having rough faces at the jaws. FIG. 13 shows an open end wrench having teeth at the jaws. The open end wrenches shown in FIGS. 12 and 13 can positively grasp and turn normal bolts and nuts, however they tend to slip when turning an excessively worn-out bolt or nut.

It is one object of the present invention to provide an open end wrench which is practical for grasping and turning hexagon head bolts and hexagon nuts as well as square head bolts and square nuts. It is another object of the present invention to provide an open end wrench which is practical for grasping and turning normal bolts and nuts of different specifications as well as worn-out bolts and nuts of different specifications. According to the present invention, the open end wrench comprises a mouth defined between two jaws and nest thereof, and a longitudinal series of transversely extended flat teeth at each of the two jaws within the mouth, wherein the longitudinal series of transversely extended flat teeth includes a first tooth remote from the nest, a third tooth adjacent to the nest, and a second tooth spaced between the first tooth and the thrid tooth by a respective transverse groove; the longitudinal lengths of the first tooth, the second tooth and the third tooth are designed at a ratio of 4:3:3; the longitudinal length of the longitudinal series of transversely extended flat teeth is equal to 0.39 of the width of the mouth, and 0.77 of the distance from the front side of the first tooth to the nest. By means of the aforesaid design, the open end wrench is practical for grasping and turning normal bolts and nuts as well as worn-out bolts and nuts.

DETAILED DESCRIPTION OF THE PREFERRED EMBODIMENT

Figure 1:
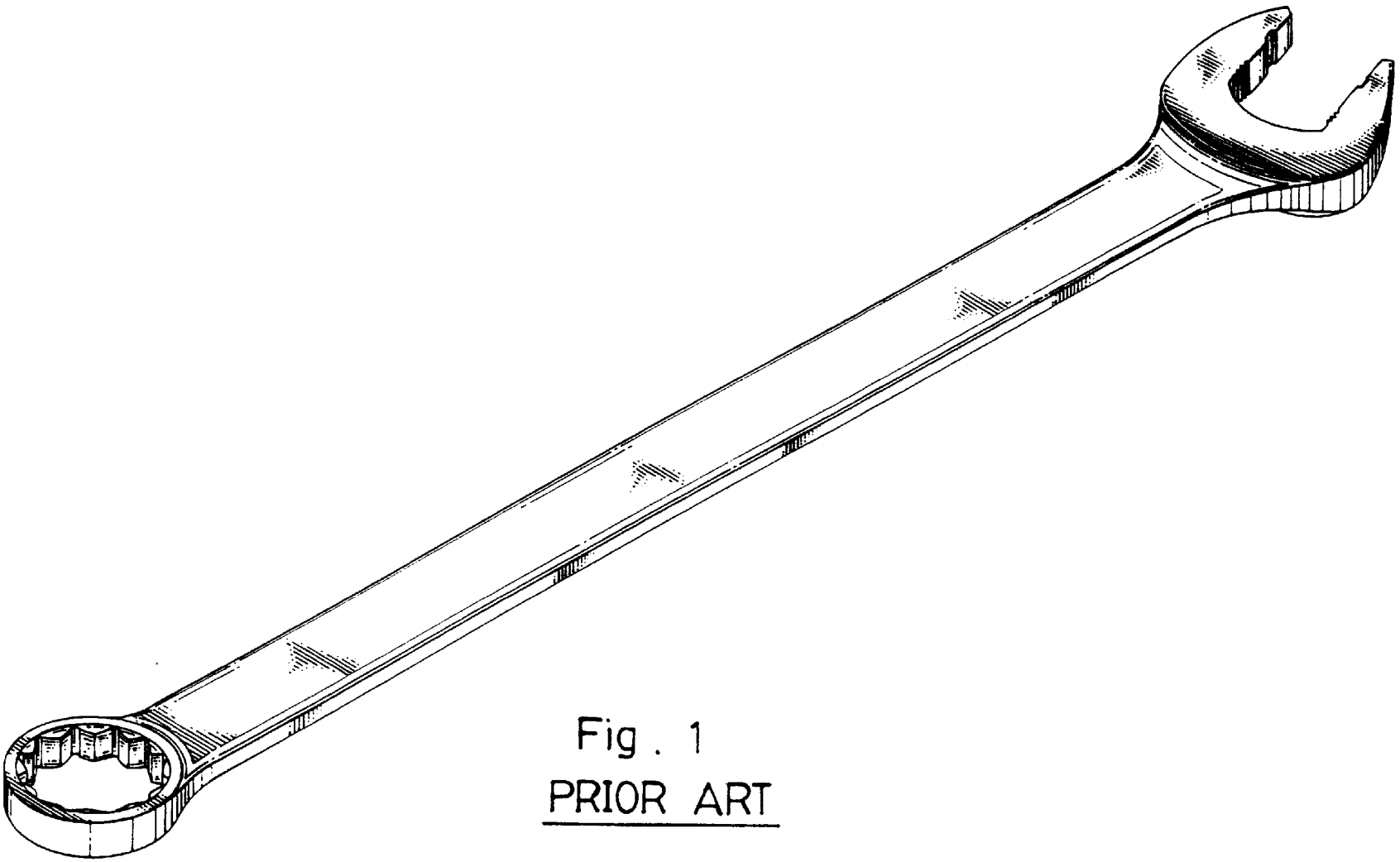
Fig. 1 PRIOR ART
FIG. 1 shows a combination wrench according to the prior art.
Figure 2:
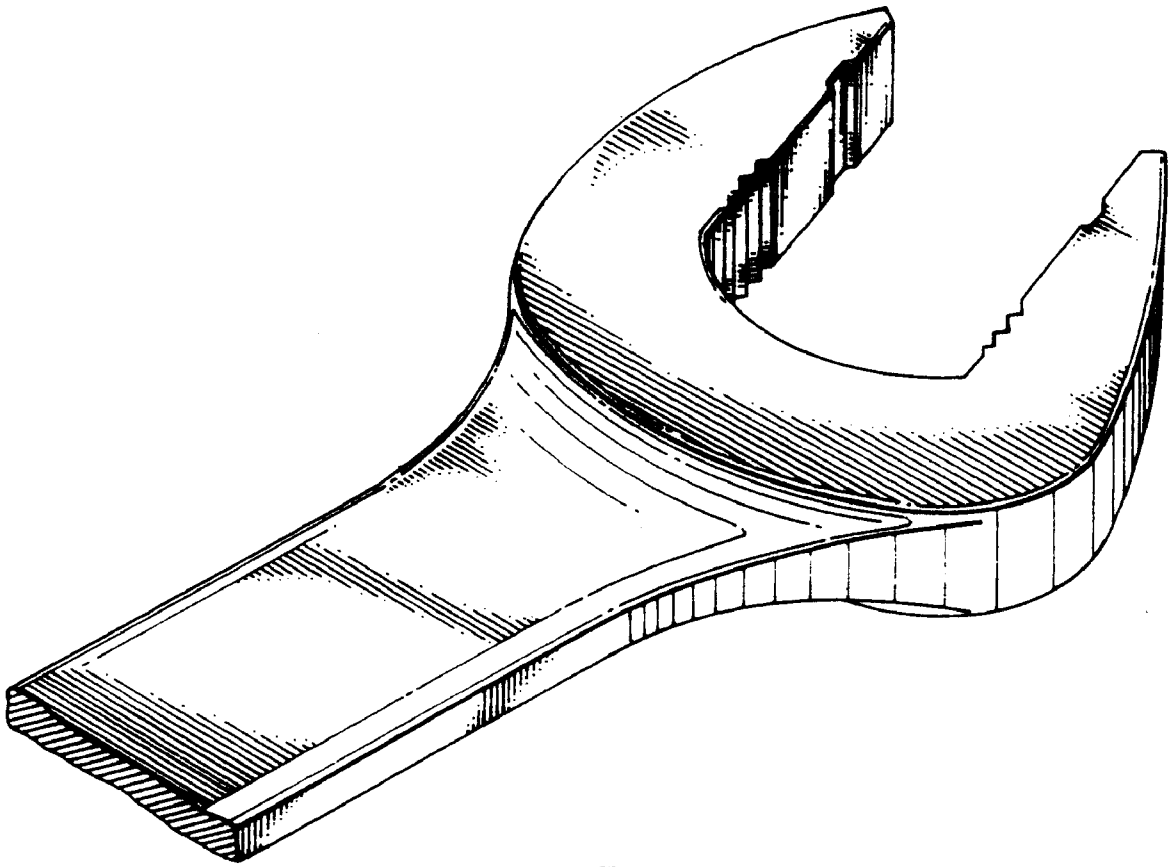
Fig. 2 PRIOR ART
FIG. 2 is an enlarged view of the open end of the combination wrench shown in FIG. 1.
Figure 4:
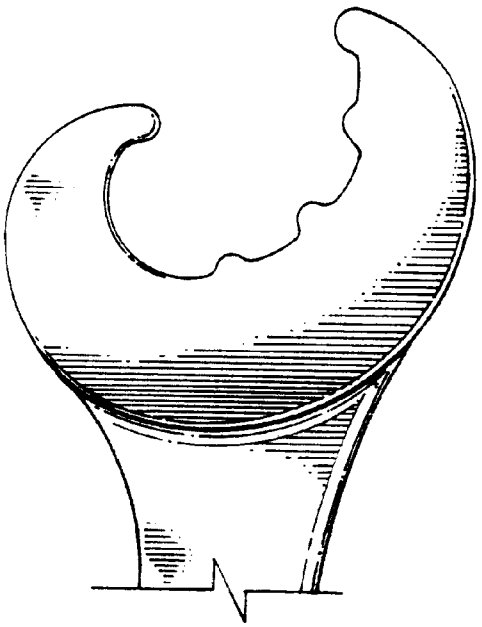
Fig. 4 PRIOR ART
FIG. 4 shows another structure of open end wrench according to the prior art.
Figure 3:
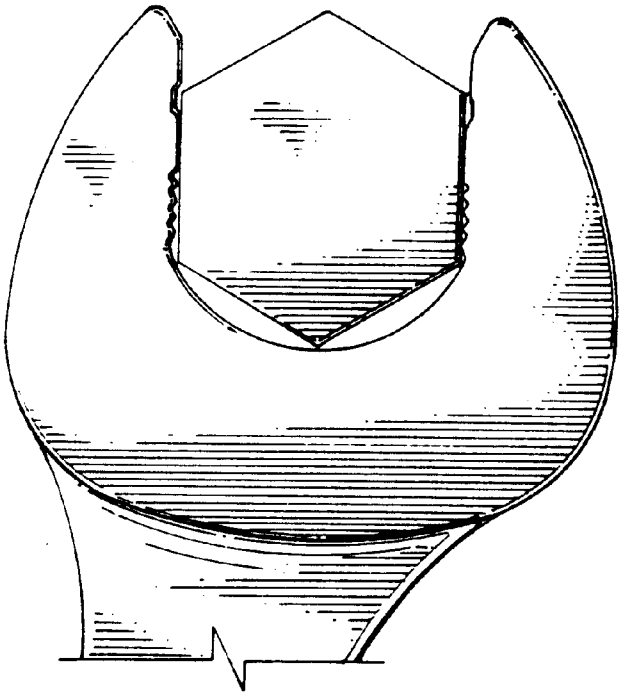
Fig. 3 PRIOR ART
FIG. 3 shows an application example of the open end of the combination wrench shown in FIG. 1.
Figure 6:
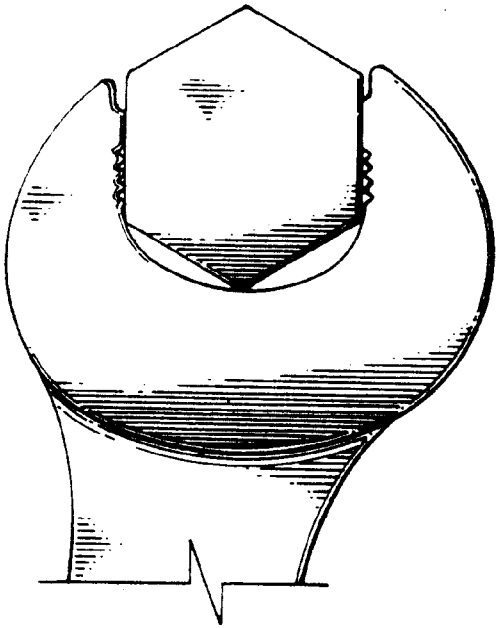
Fig. 6 PRIOR ART
FIG. 6 shows still another structure of open end wrench according to the prior art.
Figure 5:
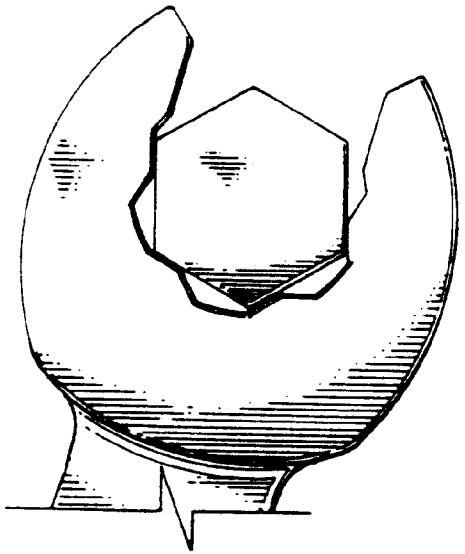
Fig. 5 PRIOR ART
FIG. 5 shows still another structure of open end wrench according to the prior art.
Figure 8:
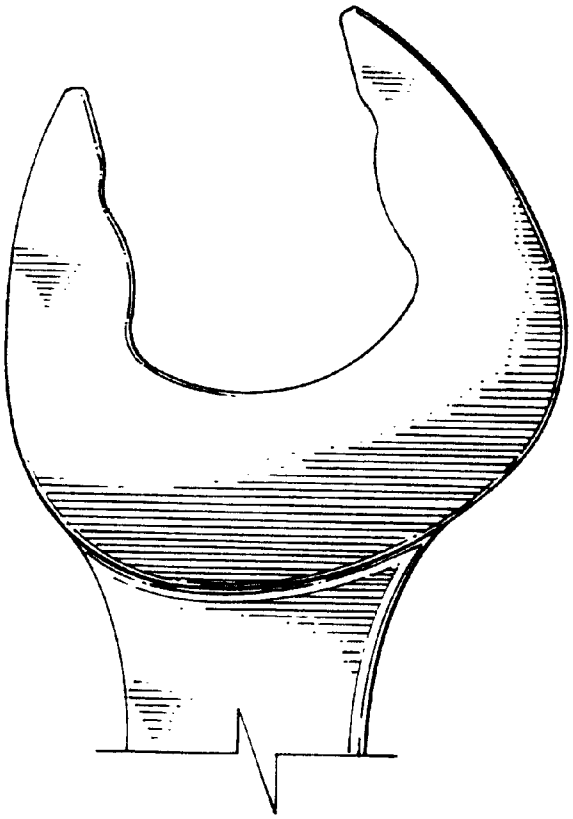
Fig. 8 PRIOR ART
FIG. 8 shows still another structure of open end wrench according to the prior art.
Figure 7:
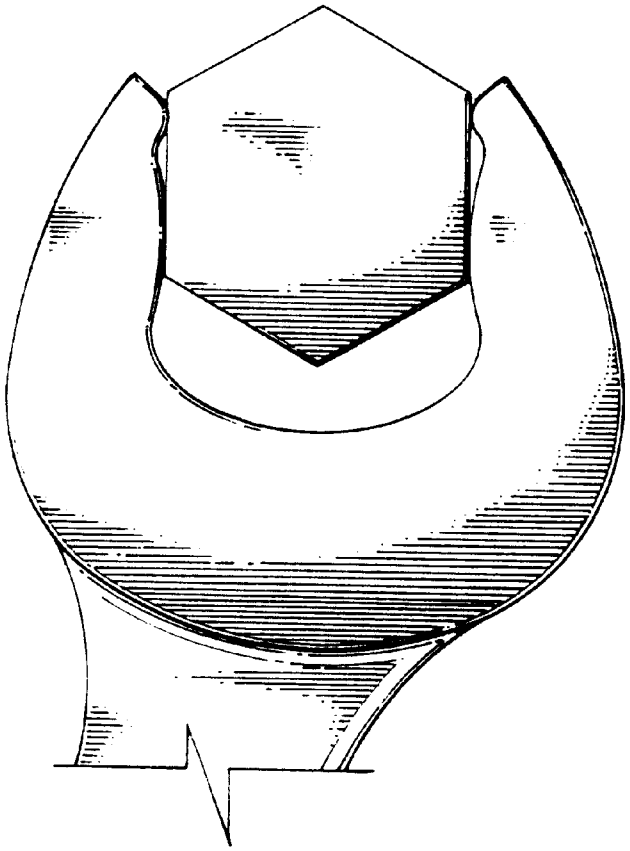
Fig. 7 PRIOR ART
FIG. 7 shows still another structure of open end wrench according to the prior art.
Figure 10:
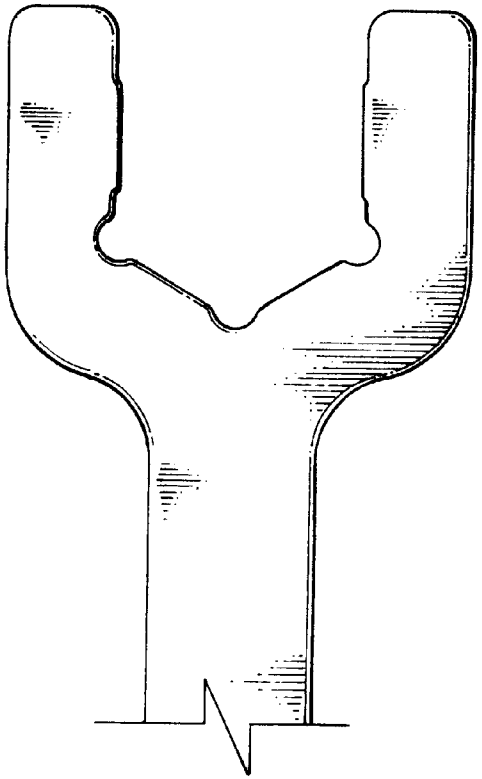
Fig. 10 PRIOR ART
FIG. 10 shows still another structure of open end wrench according to the prior art.
Figure 9:
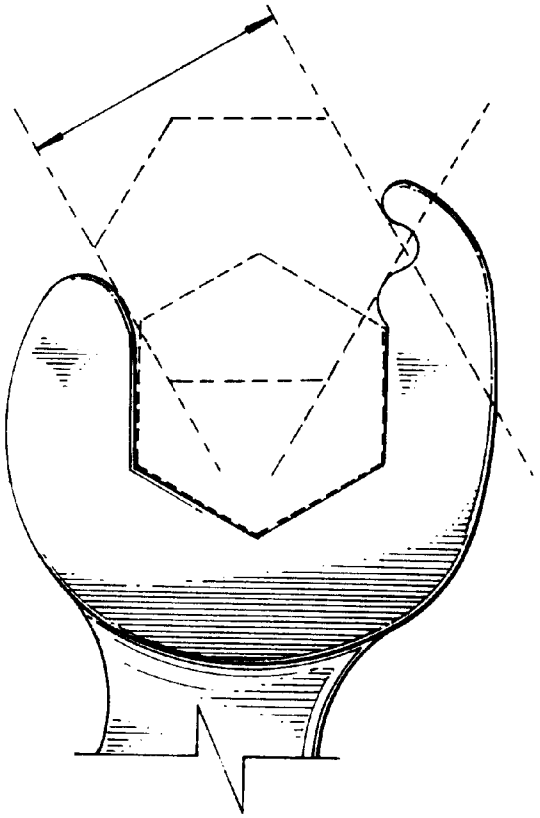
Fig. 9 PRIOR ART
FIG. 9 shows still another structure of open end wrench designed for turning bolts and nuts of different specifications according to the prior art.
Figure 11:
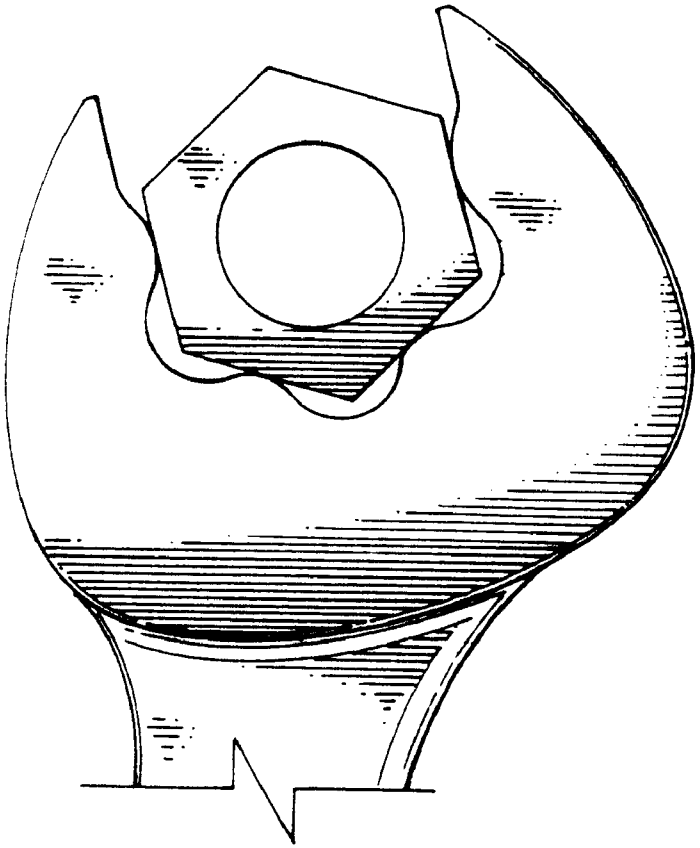
Fig. 11 PRIOR ART
FIG. 11 shows still another structure of open end wrench designed for turning bolts and nuts of different specifications according to the prior art.
Figure 13:
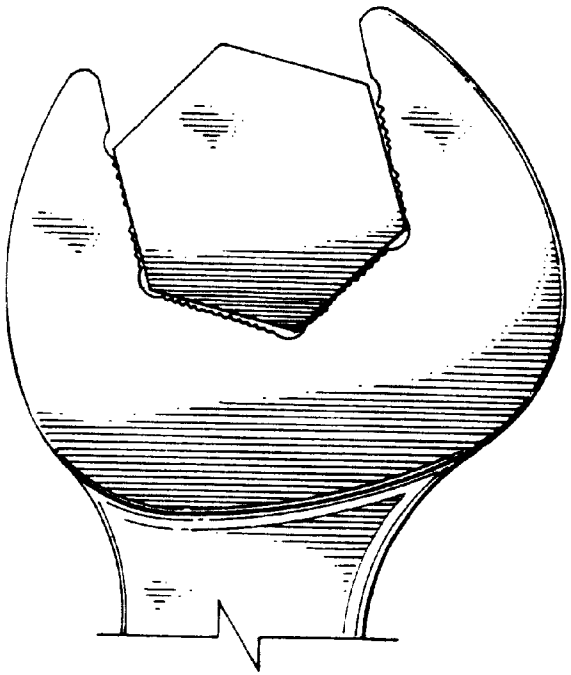
Fig. 13 PRIOR ART
FIG. 13 shows still another structure of open end wrench according to the prior art where the jaws have a respective longitudinal row of teeth at an inner side for grasping.
Figure 12:
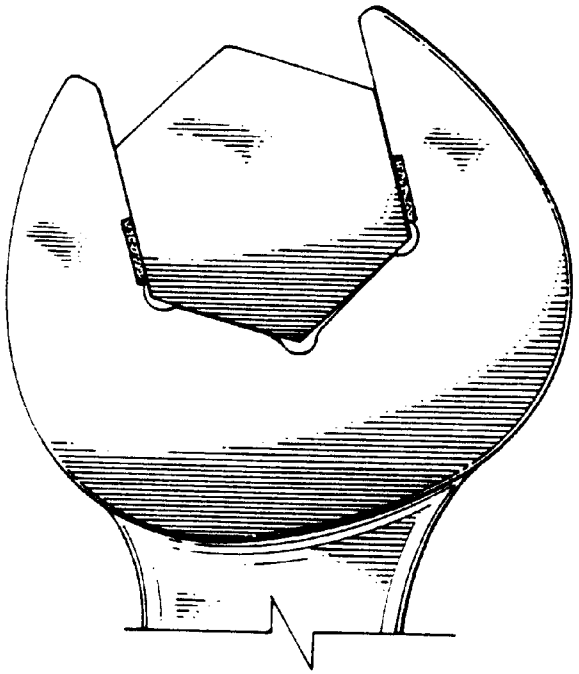
Fig. 12 PRIOR ART
FIG. 12 shows still another structure of open end wrench according to the prior art where the jaws have a respective rough grasping face at an inner side.
Figure 14:
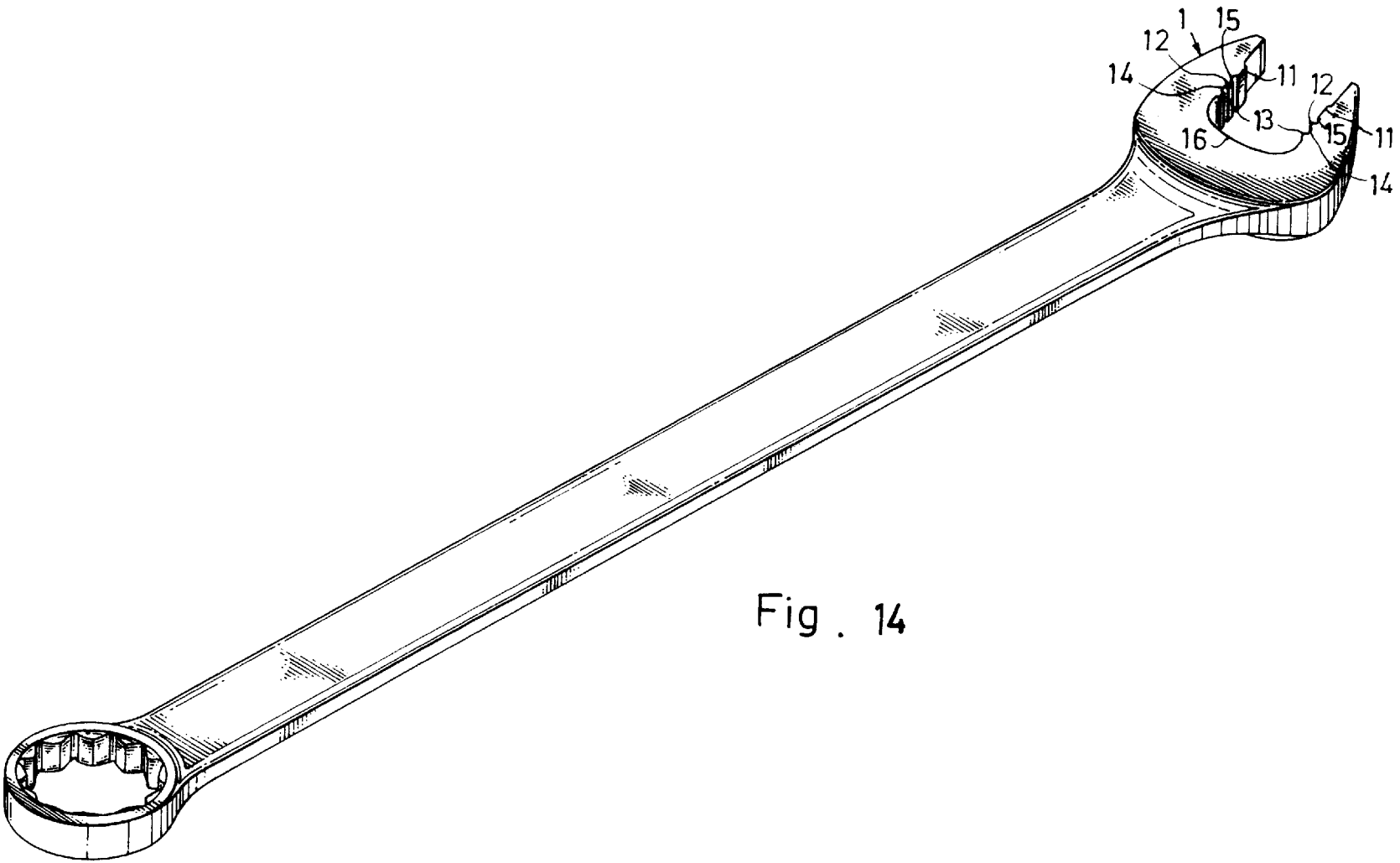
FIG. 14 shows a combination wrench with an open end constructed according to the present invention.
Figure 15:
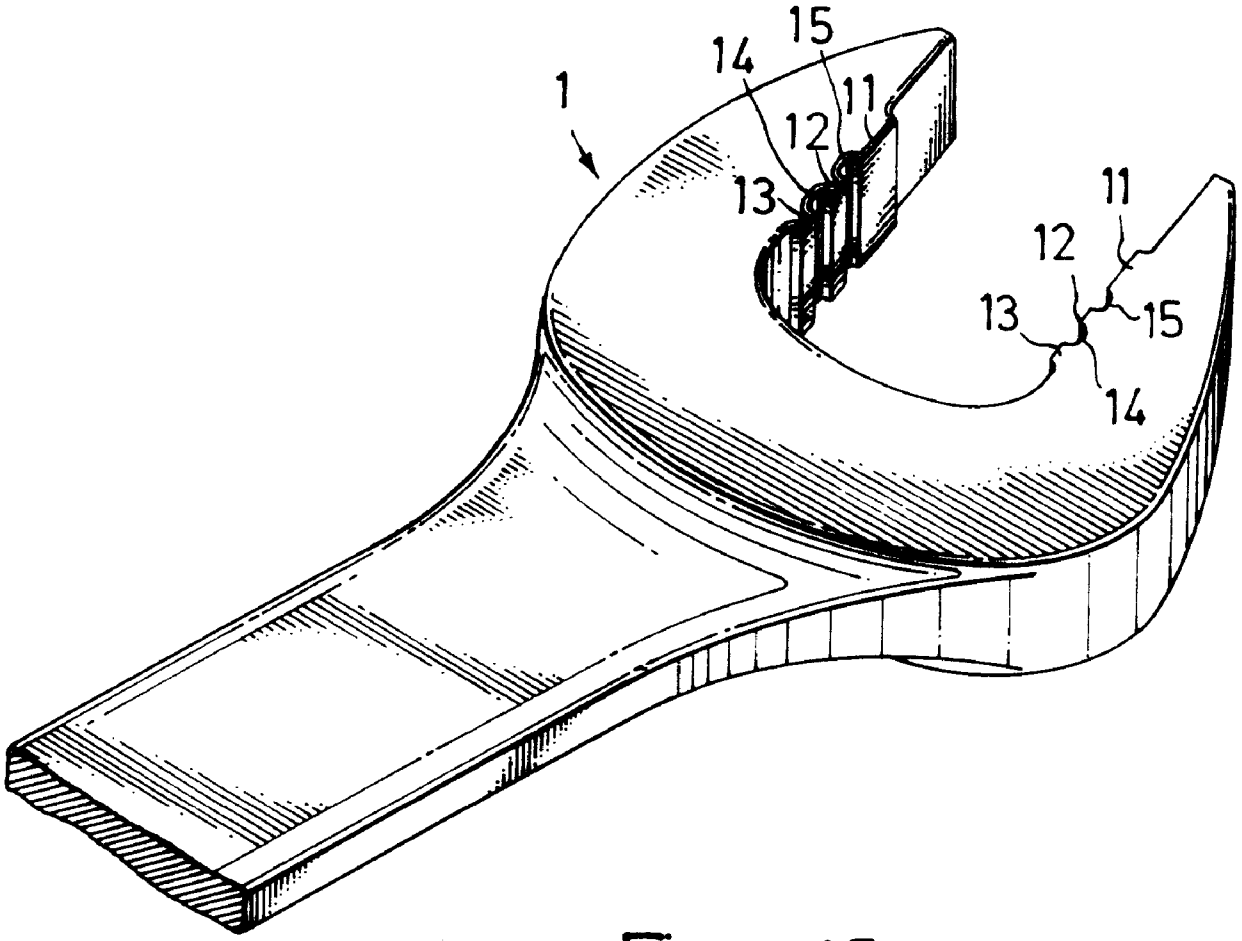
FIG. 15 is a perspective view in an enlarged scale of the open end of the combination wrench shown in FIG. 14.
Figure 16:
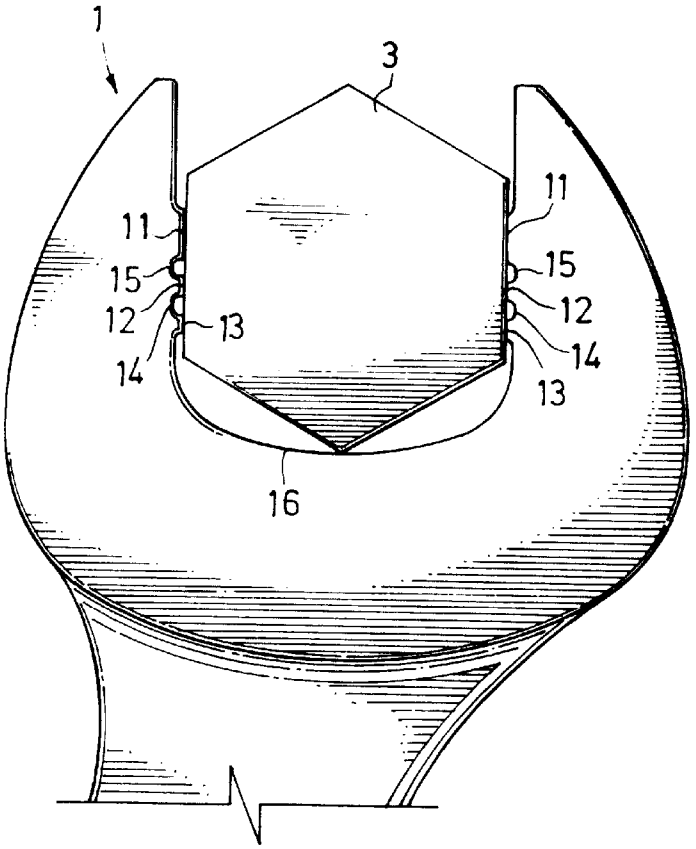
FIG. 16 shows the open end grasped on a normal hexagon head bolt according to the present invention.
Figure 17:
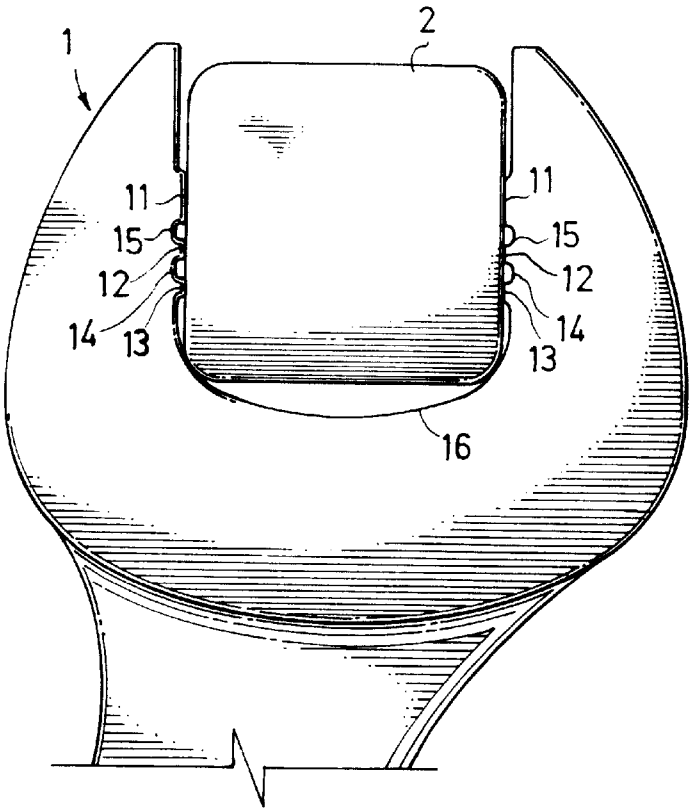
FIG. 17 shows the open end grasped on a normal square head bolt according to the present invention.
Figure 18:
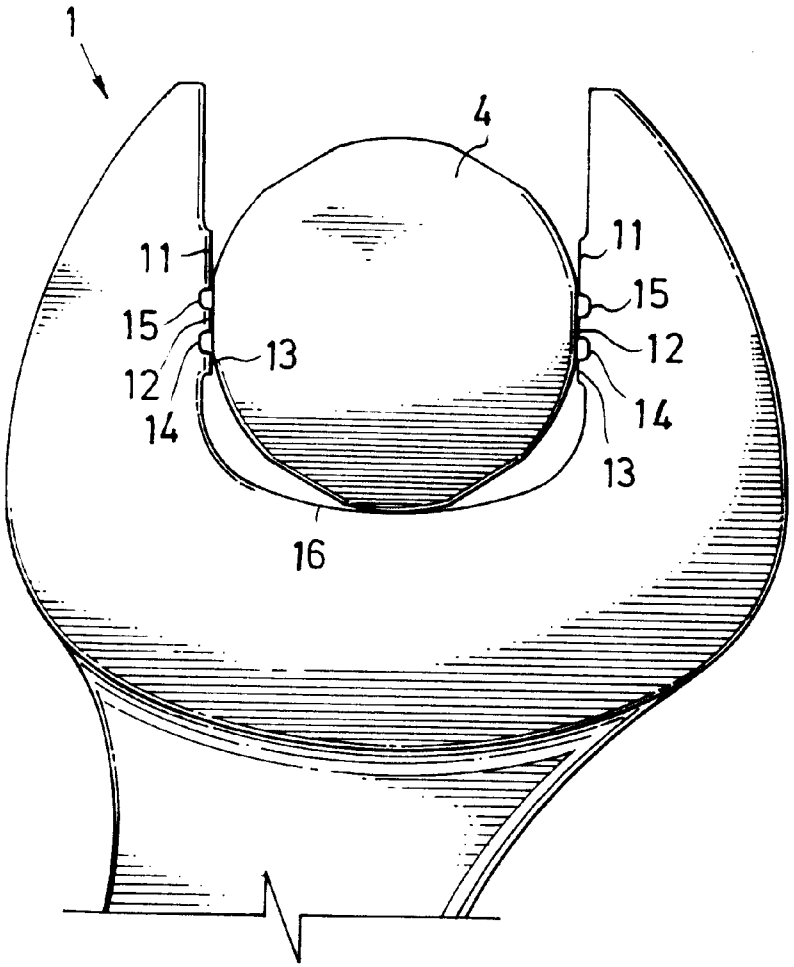
FIG. 18 shows the open end grasped on a worn-out bolts according to the present invention.
Figure 19:
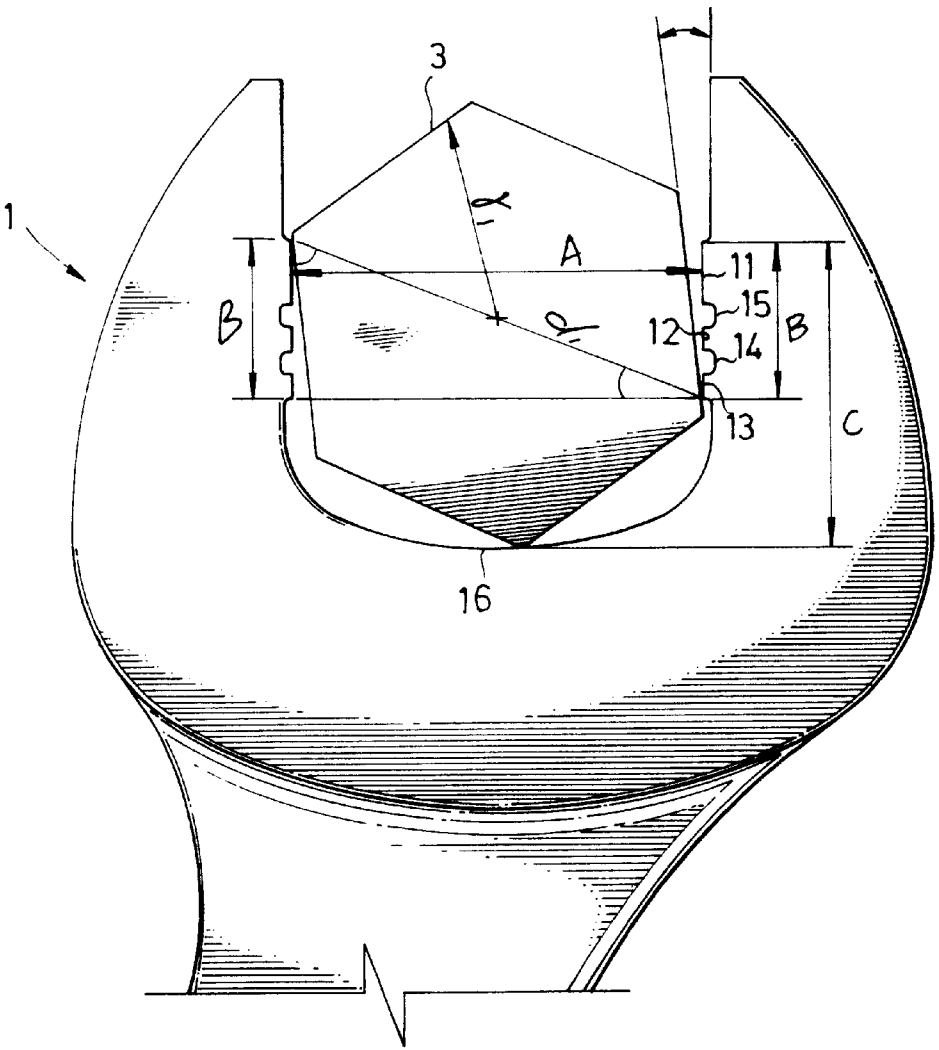
FIG. 19 shows the relationship between the open end and the hexagon head bolt to be turned.
Figure 20:
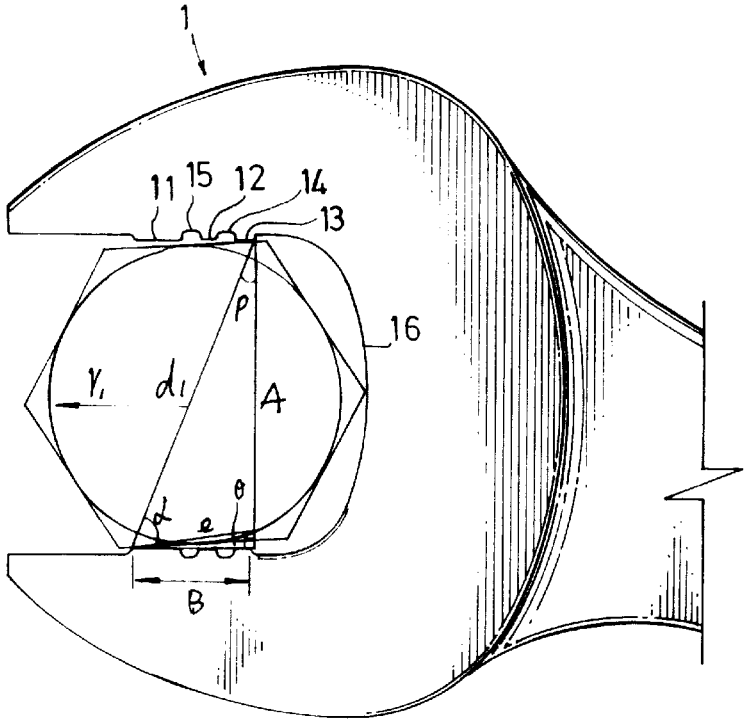
FIG. 20 is a schematic drawing explaining the design of the open end according to the present invention.
Figure 21:
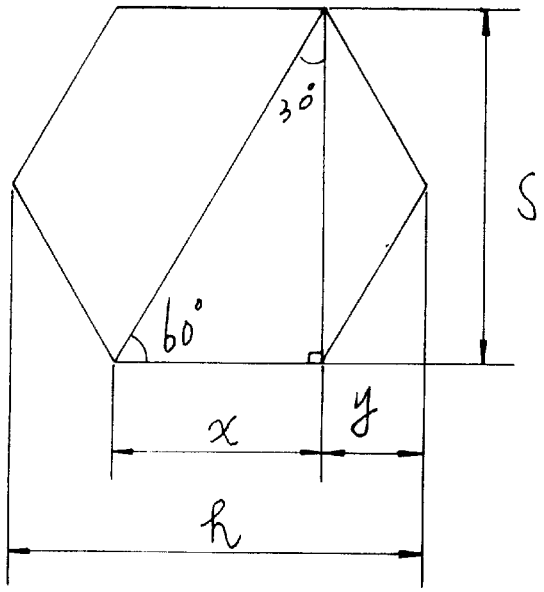
FIG. 21 is a schematic drawing explaining measurements used in the present invention.

An open end of an open end wrench according to the present invention is similar to regular open end wrenches, comprising two jaws, a nest connected between the jaws, and a mouth defined within the jaws and the nest and adapted for grasping and turning bolts, nuts, etc.

Referring to Figures from 14 to 19, the open end comprises a plurality of flat teeth, namely, the first tooth 11, the second tooth 12 and the third tooth 13 transversely disposed at each of the two jaws thereof at an inner side within the mouth. The longitudinal lengths of the first tooth 11, the second tooth 12 and the third tooth 13 are designed at a ratio of 4:3:3. The third tooth 13 is disposed adjacent to the web of the open end. The teeth 11; 12; 13 are separated from one another by transverse grooves 14; 15 of equal size. The longitudinal length B of the teeth 11; 12; 13 is equal to 0.39 of the width A of the mouth between the teeth, and 0.77 of the distance C from the front end of the first tooth 11 to the nest 16. Therefore, the third tooth 13 is practical for grasping and turning a normal square head bolt 2, the second tooth 12 is practical for grasping and turning a normal hexagon head bolt 3, the first tooth 11 is practical for grasping and turning a worn-out bolt 4 and a normal hexagon head bolt 3.

Referring to Figures from 19 to 21 when turning a normal hexagon head bolt 3, the maximum torque angle is θ1, the minimum torque angle is θ2. As known that the width of the hexagon nut is S, the maximum turnable polygonal head bolt size is S1, the minimum turnable polygonal head bolt size is S2. Further, the distance between two diagonal angles of the polygonal head 3 is h. From the data provided it is obtained that:

S=h*COS 30° . . . normal polygonal head bolt y=h−x/2 x=h*COS 60°=½h

C1=x+y=h COS 60°+h−h COS 60°/2=h/2+h/2 COS 60°=$\frac{3}{4}h^2$ d1=75% round off d1=2rl=2(0.125h+0.875S)

A=d1 COS P

W1=d1 sin α

What is claimed is:

1. An open end wrench comprising two jaws, a nest connected between said jaws, and a mouth defined within said jaws and said nest, a longitudinal series of transversely extended flat teeth at each of said two jaws within said mouth, wherein said longitudinal series of transversely extended flat teeth includes a first tooth remote from said nest, a third tooth adjacent to said nest, and a second tooth spaced between said first tooth and said third tooth by a respective transverse groove, said first tooth having a front side remote from said second tooth and a rear side adjacent to said second tooth, the longitudinal length of said first tooth, said second tooth and said third tooth being designed at a ratio of 4:3:3, the longitudinal length of said longitudinal series of transversely extended flat teeth being equal to 0.39 of the width of said mouth, the longitudinal length of said longitudinal series of transversely extended flat teeth being equal to 0.77 of the distance from the front side of said first tooth to said nest, and an edge of the respective transverse groove between said first and said second tooth and between said second and said third tooth forming a substantially right angle with the corresponding flat surface of said first, second and third teeth.

* * * * *